US006050563A

United States Patent [19]

Vedoy et al.

[11] Patent Number: 6,050,563

[45] Date of Patent: Apr. 18, 2000

[54] SHEET FEEDER

[75] Inventors: Arild Vedoy, Little Canada; Mark Nordling, Crystal; Neal F. Nordling, White Bear Lake, all of Minn.

[73] Assignee: Multifeeder Technology, Inc., Little Canada, Minn.

[21] Appl. No.: 09/032,825

[22] Filed: Mar. 2, 1998

[51] Int. Cl.[7] ..... B65H 5/00

[52] U.S. Cl. ..... 271/10.07; 271/10.04; 271/35; 271/122; 271/125; 271/165; 271/171; 271/270

[58] Field of Search ..... 271/10.04, 10.06, 271/10.07, 10.13, 35, 122, 125, 165, 171, 270

[56] References Cited

U.S. PATENT DOCUMENTS

| | | | |
|---|---|---|---|
| 941,778 | 11/1909 | Hermann . | |
| 1,061,979 | 5/1913 | Burton . | |
| 1,262,383 | 4/1918 | Otarii et al. . | |
| 1,513,254 | 10/1924 | Lovecheck . | |
| 1,594,883 | 8/1926 | Holmberg et al. . | |
| 1,637,833 | 8/1927 | Mueller . | |
| 1,741,451 | 12/1929 | Davidson . | |
| 2,145,299 | 1/1939 | Elliott . | |
| 2,192,414 | 3/1940 | Reed . | |
| 2,233,152 | 2/1941 | Welk . | |
| 2,419,345 | 4/1947 | Elliott . | |
| 2,677,543 | 5/1954 | Ohrn . | |
| 3,032,338 | 5/1962 | Anderson et al. . | |
| 3,682,471 | 8/1972 | Pahlitzsch . | |
| 3,748,937 | 7/1973 | Long . | |
| 3,762,701 | 10/1973 | Hannon et al. . | |
| 3,902,712 | 9/1975 | Dorer . | |
| 3,908,983 | 9/1975 | Long . | |
| 4,350,466 | 9/1982 | Bahr et al. . | |
| 4,368,881 | 1/1983 | Landa . | |
| 4,425,181 | 1/1984 | Bahr et al. . | |
| 4,496,339 | 1/1985 | Moll . | |
| 4,516,765 | 5/1985 | Stocco et al. . | |
| 4,651,983 | 3/1987 | Long . | |
| 4,673,175 | 6/1987 | Morita | 271/270 |
| 4,718,809 | 1/1988 | Krasuski et al. . | |
| 4,928,950 | 5/1990 | Sardella . | |
| 4,968,020 | 11/1990 | Moll . | |
| 4,993,587 | 2/1991 | Abe | 271/122 |
| 5,160,128 | 11/1992 | Oishi . | |
| 5,322,989 | 6/1994 | Long et al. . | |
| 5,385,509 | 1/1995 | Long . | |
| 5,457,941 | 10/1995 | Long et al. . | |
| 5,601,282 | 2/1997 | Milo et al. . | |

FOREIGN PATENT DOCUMENTS

| | | | |
|---|---|---|---|
| 2829151 | 1/1980 | Germany | 271/122 |
| 0206743 | 9/1986 | Japan | 271/122 |
| 971752 | 11/1982 | U.S.S.R. | 271/35 |

*Primary Examiner*—H. Grant Skaggs
*Attorney, Agent, or Firm*—Nikolai, Mersereau, & Dietz, P.A.

[57] ABSTRACT

An electromechanical friction feed device for controlling the single feed of sheet-like articles from a stack of such articles has a feed belt and stripper wheel that are used to draw a single article from the bottom of the stack to the discharge section of the feeder. The stripper wheels slowly rotate in a direction opposite to the feed movement to hold the penultimate sheet and those above it in a stack while the lowermost product is translated by the feed belt through the machine. The reverse rotation of the stripper wheel is accomplished using a dual ratchet mechanism along with unidirectional needle bearing assemblies that provide a smooth, continuous rotation of the stripper wheels. The two ratchet mechanisms are driven 180° out of phase with respect to one another to achieve the smooth continuous stripper wheel rotation. By using a dual ratchet mechanism instead of gears, the center distance between the feed belt drive shaft and the stripper wheel shaft can be adjusted to accommodate various product thicknesses. A discharge section of the friction feeder pulls the product from the feed belt and moves it at a higher velocity than that of the feed belt so as to provide separation between adjacent products being fed from the stack.

43 Claims, 12 Drawing Sheets

SHEET FEEDER

BACKGROUND OF THE INVENTION

I. Field of the Invention

This invention relates generally to apparatus for feeding sheet-like articles, one at a time, from the bottom of a stack of such articles.

II. Discussion of the Prior Art

Friction sheet feeders are known in the art and are commonly used in printers, plain paper copiers and the like to feed individual sheets, one at a time, from a stack of such sheets into the printer or copy machine. Friction feeders have also been used in mass mailing applications for assembling and collating packages of sheet materials between flights of a conveyor leading to a high speed wrapper.

It is important in such applications that the friction feeder deliver products one at a time in synchronized relation to the operation of associated equipment accurately, reliably and repeatably. For example, in the mass mailing application, a plurality of friction feeders are arranged along a length of a transversely extending conveyor and each such friction feeder must deliver only one article at the time from its stack onto the conveyor as each defined flight thereof passes the discharge end of the friction feeder. The friction feeder must therefore operate reliably, at high speeds, over prolonged periods and with a minimum operator intervention for clearing jams or multiple feeds.

Most prior art friction feeders include rollers or endless belts for supporting a stack of sheet articles thereon where the sheet articles are generally contained in a hopper mechanism. Associated with the endless belt or drive rollers is a gate member which is closely spaced relative to the endless belt such that the bottommost sheet in the stack will adhere to the endless belt and be carried through a gap while the penultimate sheet article and those above it in the stack are blocked from exiting until the bottommost sheet has cleared the nip. It is the function of the prior art gate member to allow low frictional resistance to the bottommost sheet being fed while at the same time providing a high frictional resistance at the gap through which the lowermost sheet passes to those sheets above it. A variety of such gate elements are disclosed in the prior art. For example, the Green U.S. Pat. No. 4,991,831 discloses a stationary cylindrical roll 51 disposed slightly above a friction feed belt and affording a higher frictional resistance to the penultimate sheet by providing a greater coefficient of friction at the nip than along a remaining surface thereof that normally abuts the leading edges of sheet articles in the stack. The Milo et al. U.S. Pat. No. 5,501,282 likewise utilizes a stationary gate member juxtaposed to the device's feed belt and which provides increased frictional resistance at the nip than along the remaining surface thereof by having an increased normal force at the nip than along the remaining portion of the gate member abutting the leading edges of the sheets in the stack. U.S. Pat. No. 4,651,983 to Long utilizes a friction wheel that is made to rotate in the same direction as the product movement, but at a slower speed to separate the articles in a stack of sheet articles in an attempt to allow only the bottommost sheet to pass through a gap between the drive and the gate member.

Other friction feeder manufacturers have utilized a stripper wheel that rotates in a direction which is opposite to the direction of flow of the sheet articles through the feeder in an attempt to separate the articles leaving the stack. In one such machine, however, the stripper wheel is only driven for about 50 percent of the feed cycle. That is to say, the stripper wheel was not designed to operate in a continuous motion, but only rotated 180° for every complete rotation of the friction feeders belt drive shaft. The period of no motion of the stripper wheel has been found to result in frequent episodes of multiple product feeds for various sheet articles of differing texture and thickness as well as for certain feeding speeds.

The aforementioned machines suffer from a common problem. They do not provide an even and continuous pressure on the bottommost sheet article as it is being fed, resulting in its becoming skewed and leading to a jam condition at the discharge end of the feeder. Users frequently attempt to compensate for uneven pressure conditions by misadjusting (over tightening) the gate or stripper wheel pressure. This often leads to scuff marks and other damage to the sheet articles.

SUMMARY OF THE INVENTION

The present invention provides an improved apparatus for feeding sheet-like articles, such as paper sheets, paper cards, plastic sheets or other flat products from a stack, one at a time, to a take-away conveyor. It comprises a frame with a pair of endless feed belts and a feed belt drive structure supported by the frame for driving an upper flight of the endless feed belts in a forward direction along a fixed, longitudinal path at a first predetermined speed. Also supported by the frame is a hopper that is disposed above the upper flight of the endless feed belt for holding a stack of sheet articles, such that a lowermost sheet article in the stack is engaged by the upper flight of the endless feed belts. A first rotatable shaft, comprising a stripper wheel shaft, extends transverse to the longitudinal path and supports a pair of stripper wheels thereon. The periphery of each of the stripper wheels is adjustably spaced from the upper flight of a corresponding one of the endless feed belts to define a gap through which the lowermost sheet article in the stack may pass. Means are provided for continuously rotating the stripper wheel shaft when the endless feed belts are being driven and with the periphery of the stripper wheels moving in a direction opposite to the forward direction at the gap and at a speed that is a predetermined small fraction of the first speed at which the endless feed belts are being driven. The stripper wheels cooperate with the sheet articles in the stack above the lowermost sheet article to inhibit their entry into the gap as the lowermost sheet article passes through the gap.

Rather than having pressure adjustment screws at opposite ends of the stripper wheel shaft for raising and lowering the stripper wheels relative to the endless feed belts, in the present invention, the stripper wheel shaft is journaled for rotation in floating bearing blocks disposed in bearing plates forming a part of the frame structure. The bearing blocks are spring biased in a downward direction. A single pressure adjustment screw cooperates with an adjustment rod that extends between the floating bearing blocks at a location that is midway between the ends of the floating bearing blocks. The mechanism is found to provide very uniform pressure distribution between the stripper wheels and sheet articles as they enter and pass through the nip resulting in low incidents of product skewing and increased ease of adjustment.

DESCRIPTION OF THE DRAWINGS

The foregoing features and advantages of the invention as well as others yet to be described, will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
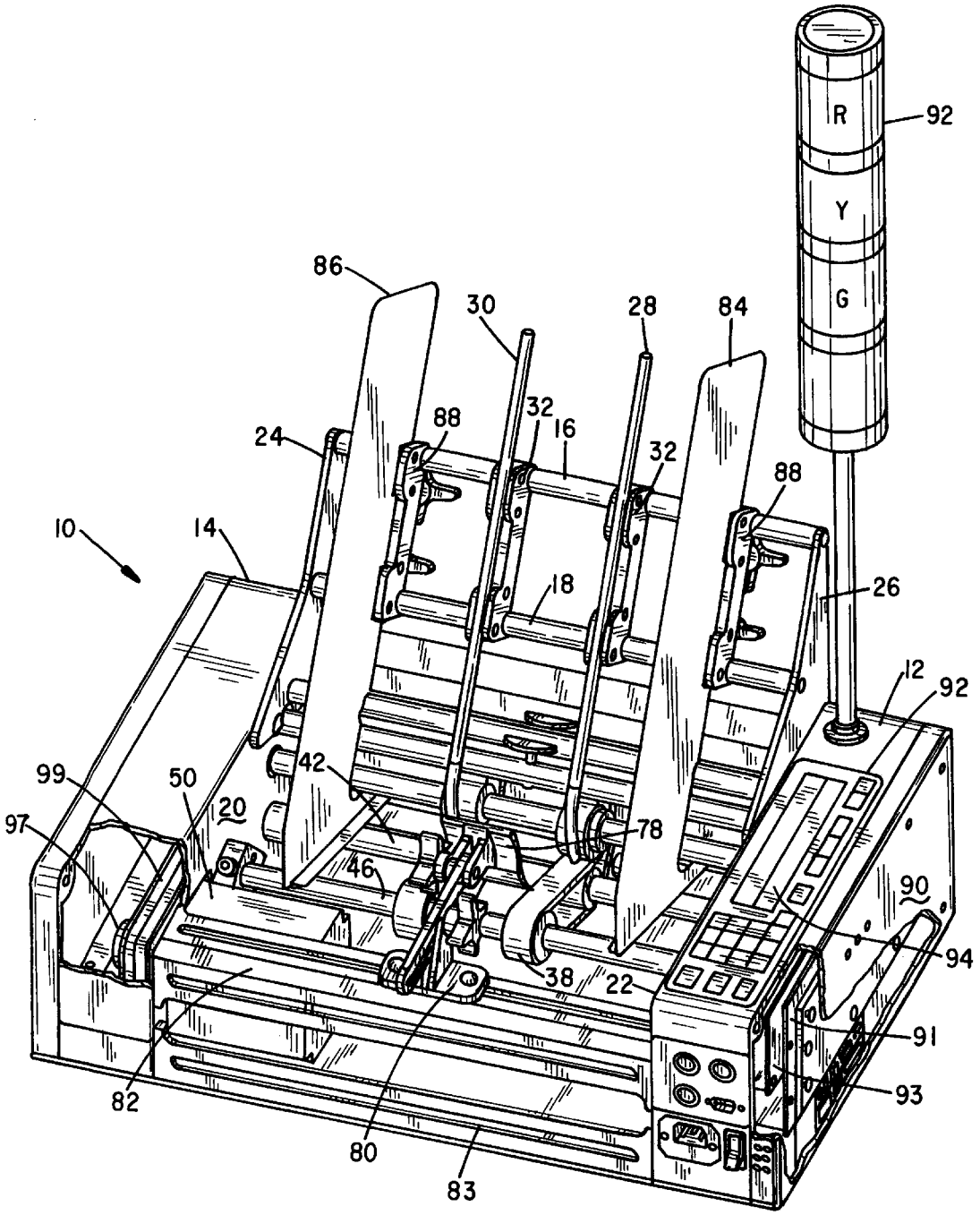
FIG. 1 is a rear perspective view of the friction feeder comprising a preferred embodiment of the present invention.
Figure 2:
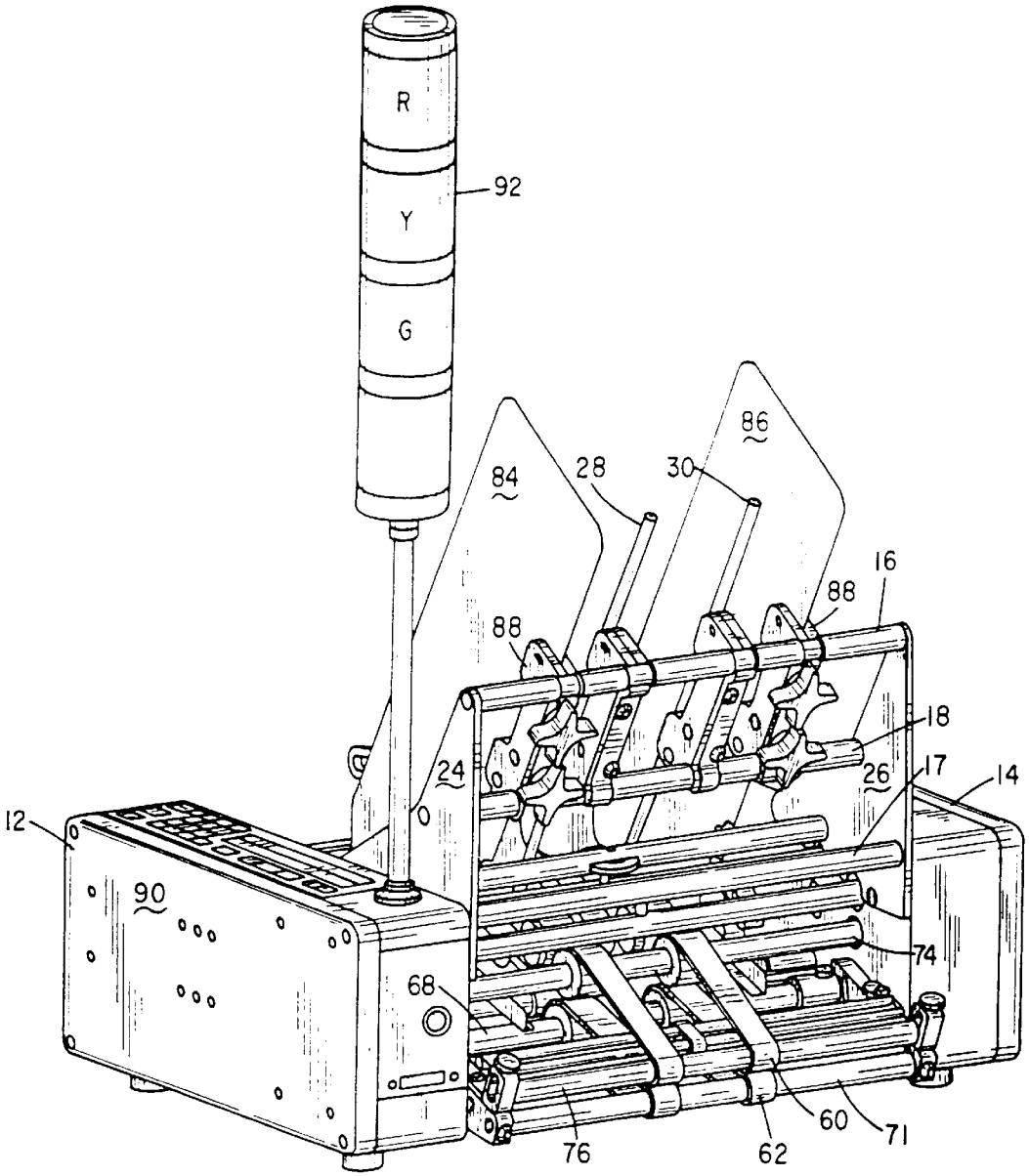
FIG. 2 is a front perspective view of the preferred embodiment of FIG. 1.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Referring to FIG. 1, there is indicated generally by numeral 10 a friction feeder construction in accordance with a preferred embodiment of the present invention. It is seen to comprise a rigid frame that includes a first box-like housing 12 and a second, similar box-like housing 14, the two being held in parallel, spaced-apart relation by means of transversely extending rigid rods 16, 17 and 18 and housing frame brackets 82 and 83. More particularly, bolted or otherwise affixed to the inside vertical walls 20 and 22 of the box-like housings 12 and 14 are housing side plates 24 and 26. Spacer rods 16, 17 and 18 bolt to the side plates as illustrated.

Supported by the transverse spacer rods 16 and 18 are front hopper guides 28 and 30. The guides are adjustably clamped by clamping members 32 so that the spacing between the guides 28 and 30 can be adjusted laterally. The front hopper guides 28 and 30 can also be adjusted vertically in the clamps 32 so that the arcuate lower end portions of the guides 30 and 32 become positionable relative to the machine's nip.

Figure 3:
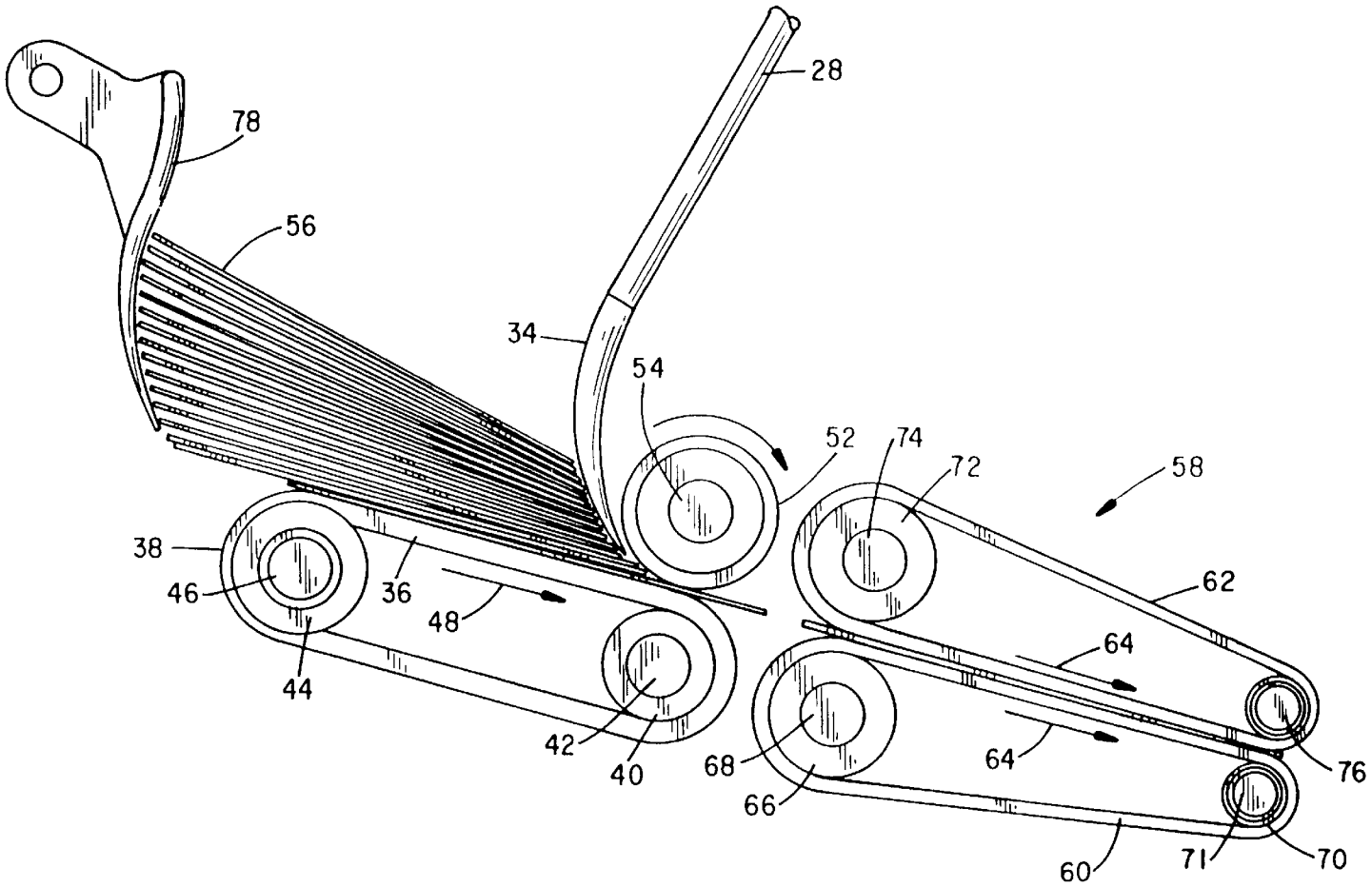
FIG. 3 is a schematic mechanical drawing helpful in understanding the operating features of the preferred embodiment.

Referring momentarily to the schematic drawing of FIG. 3, the guide 28 has an arcuate lower end portion 34 positioned above an upper flight 36 of a pair of endless feed belts 38. The endless feed belts 38 are provided with an outer covering having a relatively high coefficient of friction and with the outer layer of the belts being notched at regularly spaced intervals to enhance their frictional engagement with the sheets and to provide channels for receiving and carrying away chaff from the sheet articles. The endless belts 38 are deployed about a pair of drive rollers 40 mounted on and affixed to a feed belt drive shaft 42 and a corresponding pair of idler rollers 44 journaled by needle bearings on a stationary feed belt spanning shaft 46.

The endless feed belts 38 are adapted to be driven in the direction of the arrow 48 by an electric motor 50 (FIG. 1) in a manner which will be described in considerably more detail hereinbelow.

Cooperating with the upper flight 36 of the endless drive belts 38 are stripper wheels 52 that are mounted on and affixed to a stripper wheel shaft 54 to create a nip between the stripper wheels and the endless feed belts. A gap exists at the nip for permitting a lowermost sheet article in the stack 56 to exit while restraining the penultimate sheet article and those above it from entering the gap until the trailing edge of the lowermost sheet clears the gap.

With continued reference to FIG. 3, there is indicated generally by numeral 58 the discharge belts that carry the sheet articles delivered to it, one at a time, to a take-away conveyor or the like (not shown). The discharge assembly 58 includes a lower endless discharge belts 60 and upper endless discharge belts 62 that have their adjacent flights moving at the same speed and in the same direction, as indicated by arrows 64. The lower endless discharge belts 60 are deployed about crowned aluminum discharge belt pulleys 66 affixed to and rotatable with lower discharge shaft 68 and about needle bearing journaled idler nose rollers 70 mounted on stationary shaft 71 and spans the discharge end of the feeder. In a very similar fashion, the upper endless discharge belts 62 are deployed about crowned rollers 72 disposed on and affixed to an upper discharge shaft 74 and about nose rollers journaled for rotation on a stationary idler shaft 76. Again, the manner in which the shafts 68 and 74 are driven by the motor 50 (FIG. 1) will be explained further hereinbelow.

The schematic drawing of FIG. 3 also illustrates a rear guide member 78 for supporting the rear edges of the sheets in the stack 56. The rear guide member has an arcuate surface corresponding in shape to the curvature of the lower end portion 34 of the front guides 28 and 30. We have determined that by providing the corresponding curvature to the rear guide member, the several sheets in the stack will shingle slightly as they drop down toward the friction feed belt upper flights 36 and tend not to become wedged and stuck in the hopper.

With reference again to FIG. 1, it can be seen that the rear guide member 78 is mounted on a slide bracket 80 that can be shifted laterally along a slotted angle bar 82 that extends between the vertical wall surfaces 20 and 22 of the box-like housing members 12 and 14. Alternatively, this support curve assembly 78 can also be mounted on top of angle bar 82 or on the back side to accommodate longer products. The rear guide member 78 is also adjustable inwardly and outwardly relative to the front guides 28 and 30 and can also be rotated or tipped in the vertical direction so that, irrespective of the dimensions of the sheet articles, the curvature of the guide member 78 can be made to parallel the curvature of the lower arcuate end portions of the front guides 28 and 30.

Completing the hopper assembly are positionable right and left side plates 84 and 86, respectively. These side plates are mounted in brackets 88 that also are slidable along the spacer rods 16 and 18 so that they can be made to closely straddle the side edges of the sheets in the stack. The side plates 84 and 86 may also contain a 90° bend or lip that extends forwardly towards the discharge assembly to better guide the products which are important when feeding into close tolerance boxes.

Disposed within the first box-like housing 12 and accessible through its removable cover 90 is all of the electronics necessary to run the feeder. Included are a microprocessor board 91 and a motor control board 93 containing the electronics for controlling the operation of the friction feeder. Visible atop the first housing 12 is a control panel 92 comprising a membrane keypad and a LCD display panel 94 that is used to display status information and prompts helpful in programming in various parameters including the sheet article's feeding length, speed, sheet count, sheet thickness and various other parameters that become stored in the memory of the microprocessor and are used in controlling the delivery of sheets from the stack.

Also affixed to the housing member 12 is a semaphore 92 for providing a visual signal to an operator that the feeder may require attention. A red light signals a feeder fault, e.g., multiple products detected, misfeeds, watch dog jam or watch dog no product condition. A watch dog no product occurs if the feeder runs out of product. A flashing yellow light indicates low product and a green light indicates a ready or no-fault state.

Figure 4:
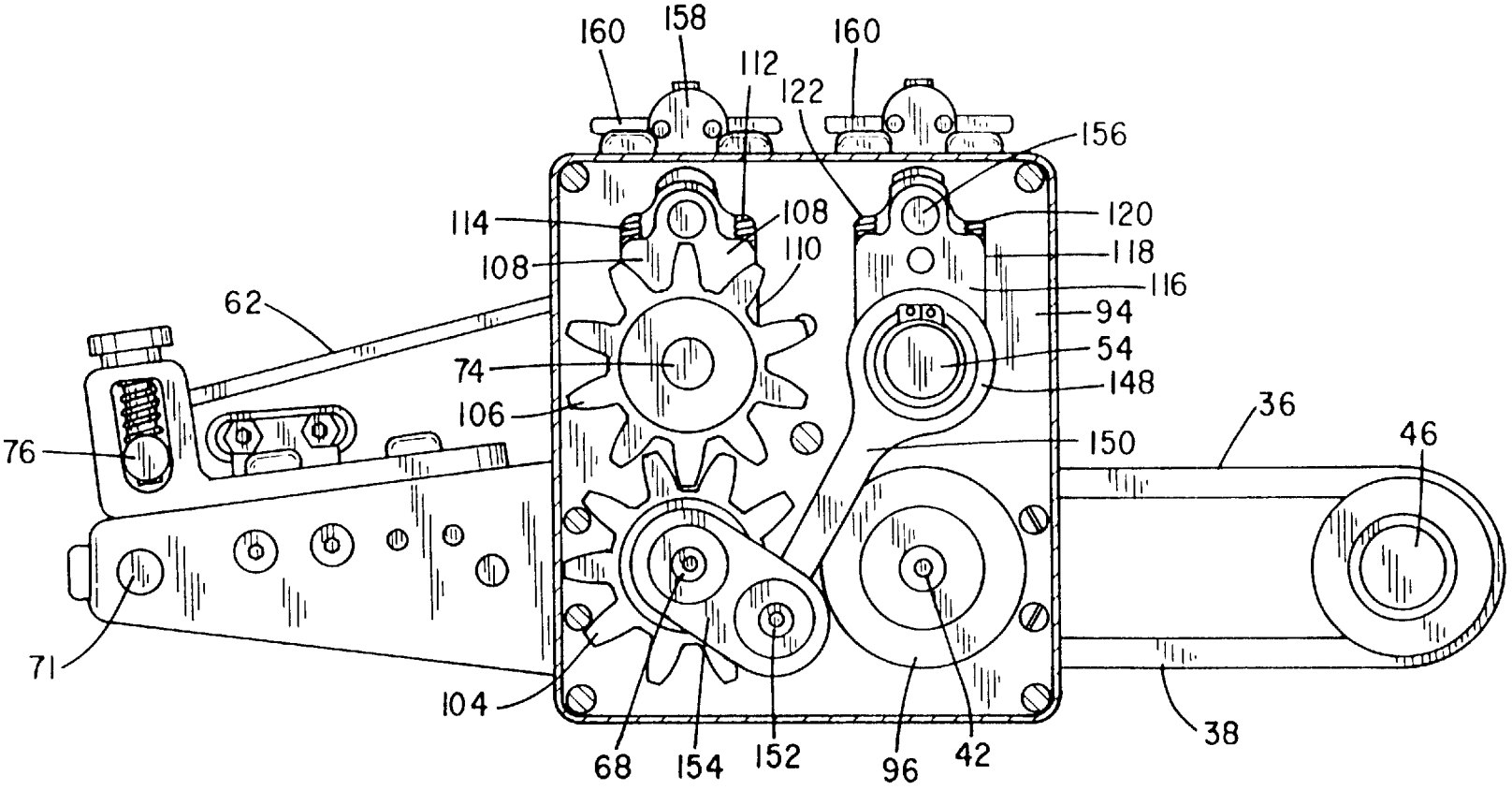
FIG. 4 is a partial left side elevational view of the preferred embodiment with the left side housing removed.
Figure 5:
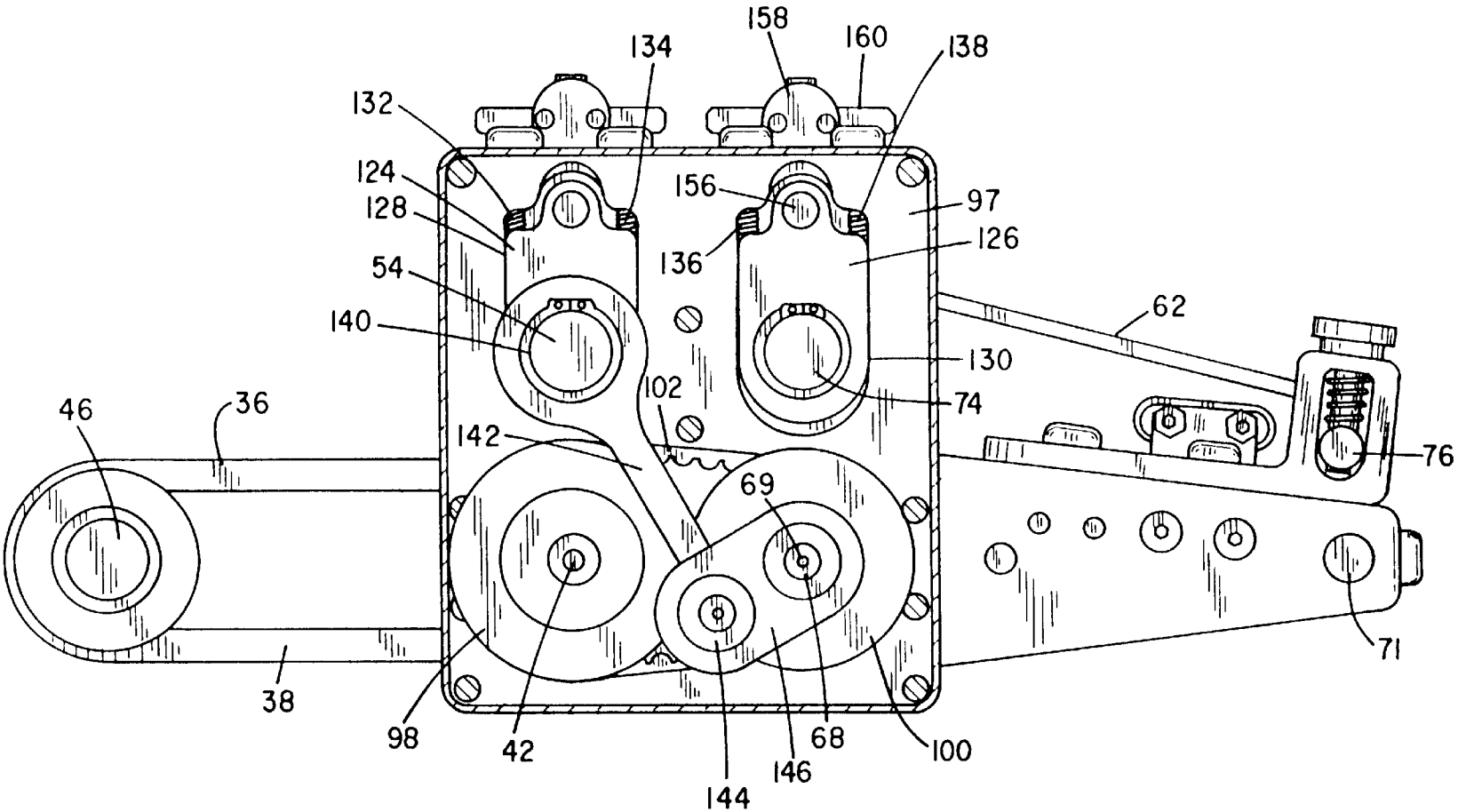
FIG. 5 is a partial right side elevational view of the preferred embodiment with the right side housing removed.

To better understand the drive mechanism for the endless feeder belts 36 and the upper and lower endless discharge belts 62 and 60, FIGS. 4 and 5 respectively show a left side view and a right side view with the housings removed to reveal the working parts. As can be seen, the feed belt drive shaft 42 passes through a circular opening in the housing wall 20 and then through a similar hole in a bearing support plate 94 that is affixed to the inside of the wall 20 of the housing 14. Secured to the free end of the feed belt drive shaft 42 is a pulley 96 that is adapted to be driven by the motor 50 by way of a pulley 97 and timing belt 99 (FIG. 1). Referring next to FIG. 5, it can be seen that the shaft 42 passes through a circular opening formed in the wall 22 of the housing 12 and through a hole formed in a right bearing support plate 97 and that a timing belt pulley 98 is affixed to the right end of the shaft 42. The lower discharge belt shaft 68 is journaled for rotation in bearings (not shown) disposed in the right bearing support plate 97 and a further timing belt pulley 100 is affixed to the protruding end of the shaft 68. A notched timing belt 102 is deployed about the pulleys 98 and 100 so that rotation of the feed belt drive shaft 42 by the motor 50 also rotates the lower discharge output shaft 68. The pulley 100 is of a slightly smaller diameter than the pulley 98 so that the discharge belt pulley 100 moves about 12 percent faster than the infeed belt 36.

Referring again to FIG. 4, the left end of the lower discharge belt shaft 68 is journaled for rotation in the bearing support plate 94 and has a spur gear 104 keyed to it. The spur gear 104 is arranged to mesh with a similar spur gear 106 that is affixed to the left end of the upper discharge belt shaft 74. Hence, the upper discharge shaft 74 is made to turn at the same rotational speed as the lower discharge belt shaft 68, causing the adjacent flights of the discharge belts 62 and 60 to move in the forward direction at the same linear speed.

The upper discharge shaft 74 is journaled for rotation in a sliding bearing block 108 that is fitted into a vertically oriented slot 110 formed in the bearing support plate 94. The sliding bearing block 108 preferably has its side edges treated with Teflon® or other lubricious material so too be free to move up and down vertically within the slot 110. It is normally urged in a downward direction by compression springs 112 and 114 operatively disposed between shoulders formed on the sliding bearing block 108 and the upper edge of the slot 110 in the bearing mounting plate 94.

By providing elongated teeth on the spur gears 104 and 106, they continue to remain meshed even with upward displacement of the shaft 74 against the force of the compression springs 112 and 114.

The stripper wheel shaft 54 is also journaled for rotation in a sliding bearing block 116 fitted into a vertically oriented slot 118 in the bearing support plate 94. Again, compression springs 120 and 122 normally urge the sliding bearing block 116 and the shaft 54 downward toward the feed belt drive shaft 42.

Returning again to FIG. 5, it shows the right ends of the stripper wheel shaft 54 and the upper discharge shaft 74, each being journaled for rotation in separate sliding bearing blocks 124 and 126, respectively. These sliding bearing blocks are again fitted into vertically oriented slots 128 and 130 in the bearing support plate and are preferably coated along their side edges with a lubricious material for facilitating low friction sliding contact between the bearing blocks and their associated slots. Compression springs, as at 132, 134, 136 and 138, normally urge the sliding bearing blocks 124 and 126 toward the underlying shafts 42 and 68.

In order to drive the stripper wheel shaft in a direction opposite to the forward movement of sheets through the gap, a one-way ratchet-type needle clutch member 140 surrounds and cooperates with the shaft 54 and is coupled, via an arm linkage 142, journaled onto link 146 that is again journaled onto a pivot bolt 69 affixed to the outer end of the lower discharge shaft 68. By rotating the lower discharge shaft 68, the pivot bolt 69 rotates in an eccentric circle, making the link 146 oscillate back and forth. This back and forth motion of the link 146 causes the link arm 142 to have the pressed-in needle roller clutch turn the stripper wheel shaft 54 in a reverse rotation for 180° of the lower discharge shaft 68 rotation and clutches for the remaining 180° of rotation of that shaft.

A one-way needle roller clutch 125 is also pressed into the sliding bearing block 124 to help stabilize the stripper wheel shaft and prevent it from potentially rotating in the forward direction. The link 146 allows the sliding bearing block 124 to be adjusted up or down without interfering with the contra running stripper wheels.

Figure 6:
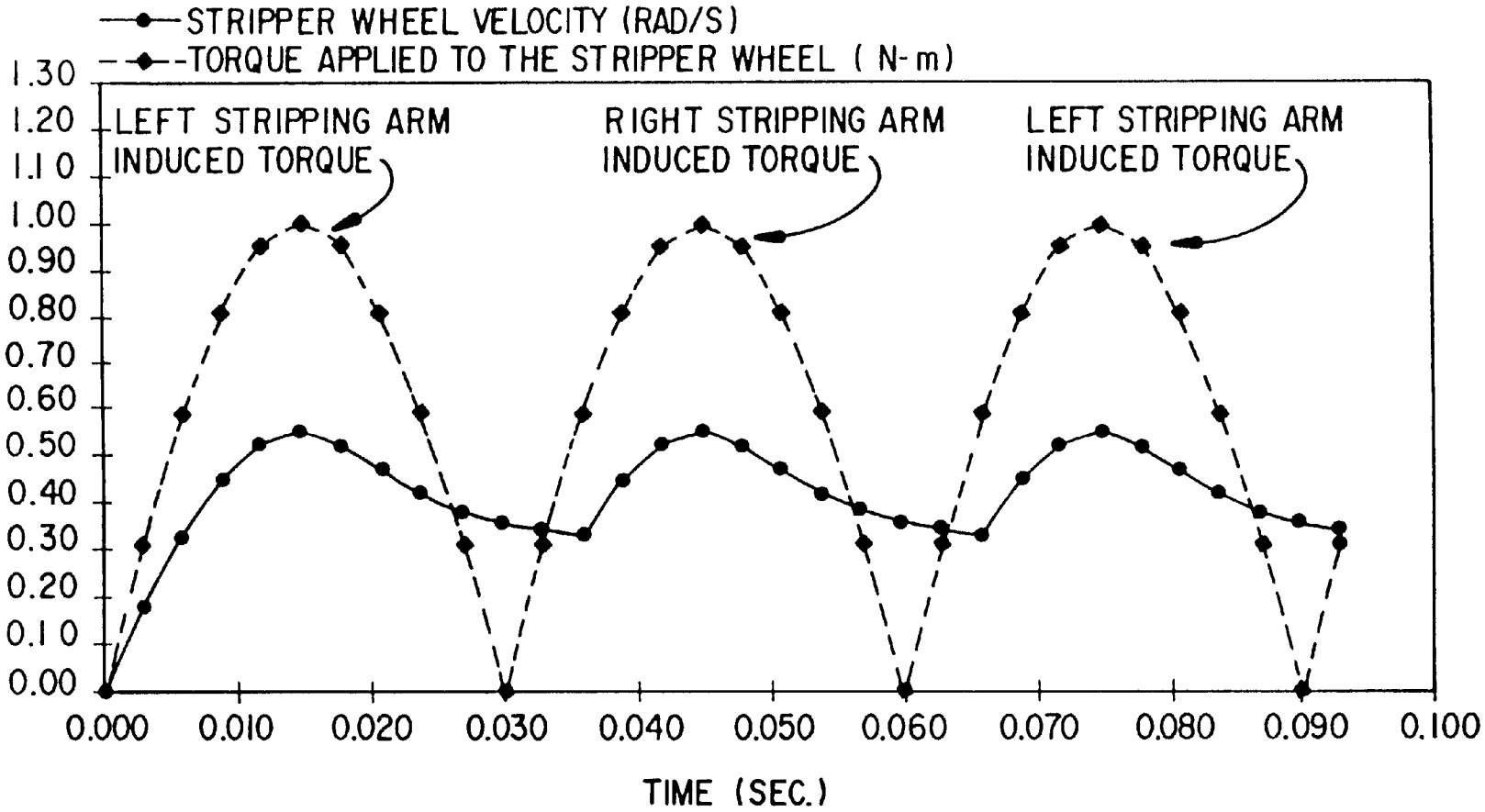
FIG. 6 is a plot of the stripper wheel velocity as a function of applied torque.
Figure 7:
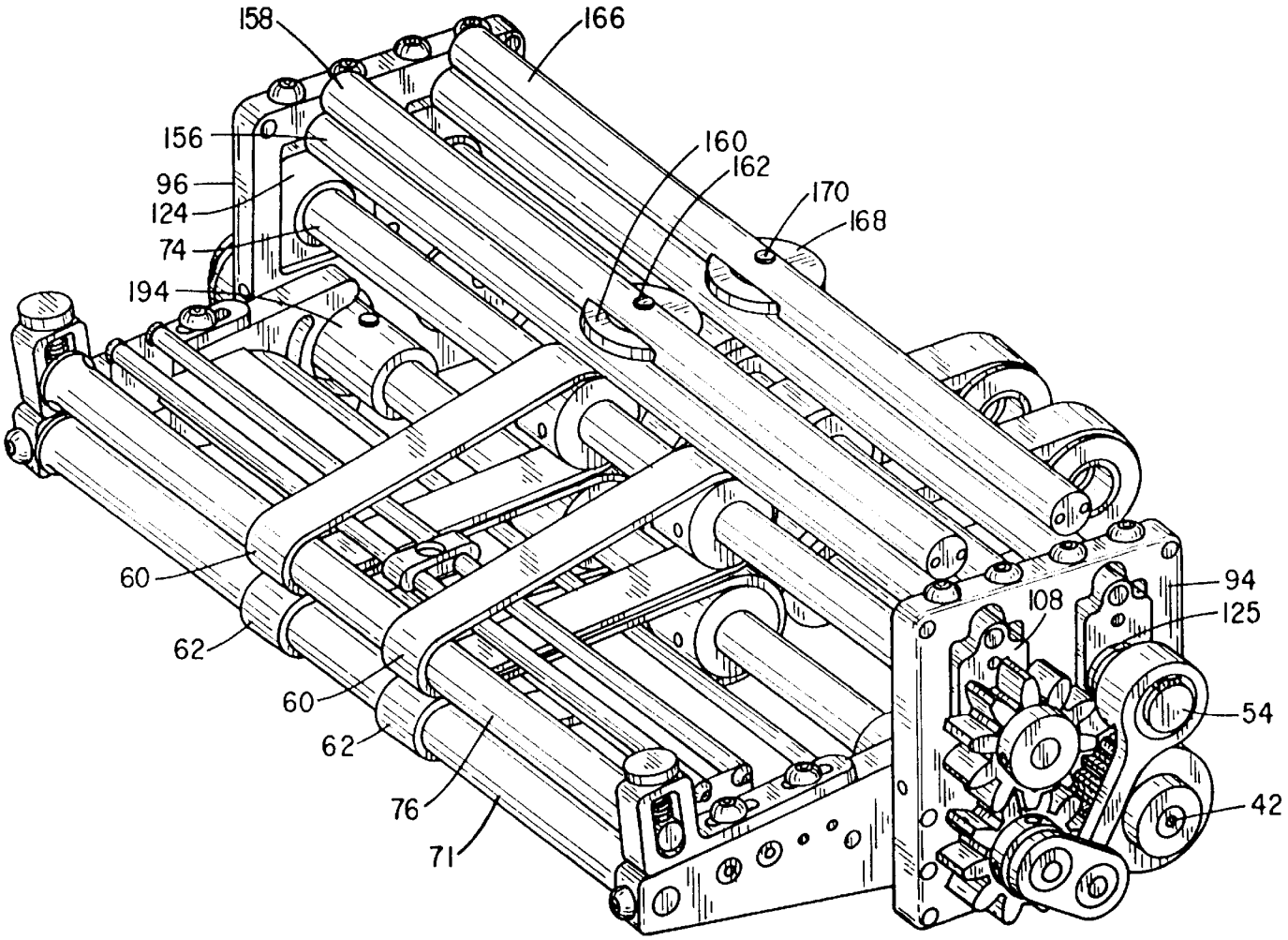
FIG. 7 is a left front perspective view of the friction feeder with the housings removed.

As the lower discharge shaft 68 rotates through a first angle of 180°, a rotational torque will be applied to the stripper wheel shaft 54 via one-way clutch 148 and during the succeeding 180° rotation of the lower discharge shaft 68, the one-way clutch 140 will apply torque to the stripper wheel shaft 54. The dotted line curve shown in FIG. 6 represents the torque applied to the stripper wheel shaft measured in Newton-meters while the solid line curve is a plot of the stripper wheel velocity measured in radians per second. It can be seen from this plot that the two drives are 180° out of phase and that while the torque delivered to the stripper wheel shaft goes to zero at periodic sinusoidal intervals, due to inertia, the stripper wheel shaft rotates continuously. The instantaneously moment of zero driving torque on the stripper wheel shaft occurs during a fraction of the time when the pivot arms 142 and 150 switches between a driving mode and a clutch mode. That is, the left side pivot arm is rotating the stripper wheel shaft while the right side pivot arm is in its clutch mode, and vice versa. This concept can be easily extended to more than two out-of-phase pivot arm clutch mechanisms to further increase the smoothness of the velocity plot. Due to the clutch and linkage drive arrangement for the stripper wheel shaft, it moves at a small fraction of the rotational speed of the lower discharge shaft, typically 1/280th of the discharge shaft speed.

Turning next to FIGS. 7 through 11, an explanation will be given as to how the gap between the counter rotating stripper wheel 52 and the upper flight 36 of the endless feed belt 38 may be adjusted with a single adjustment knob. Similarly, the manner in which the spacing between the upper and lower discharge belts is set will also be explained. An adjustment rod member 156 (FIG. 7) extends across the width dimension of the friction feeder and has its opposed ends inserted into bores formed in the upper ends of the slide bearing blocks 108 and 124 in which the upper discharge shaft 74 is journaled. Positioned immediately above the adjustment rod member 156 is a first stationary rod member 158 that is bolted at each end to the side plates 24 and 26 (FIG. 1) providing further rigidity to the feeder's frame structure. A thumb wheel 160 is affixed to a vertically oriented threaded rod 162 whose lower end engages the adjustment rod 156. Rotation of the thumb wheel 160 in a first direction pushes downward on the shaft 156 at the midpoint. This, in turn, urges the slide blocks 128 and 108 along with the shaft 74 downward so as to narrow the gap between adjacent flights of the discharge belts 60 and 62. Rotation of the thumb screw 160 in the opposite direction lifts the shaft 74 to increase the spacing of the gap between the cooperating flights of the discharge belts.

Figure 8:
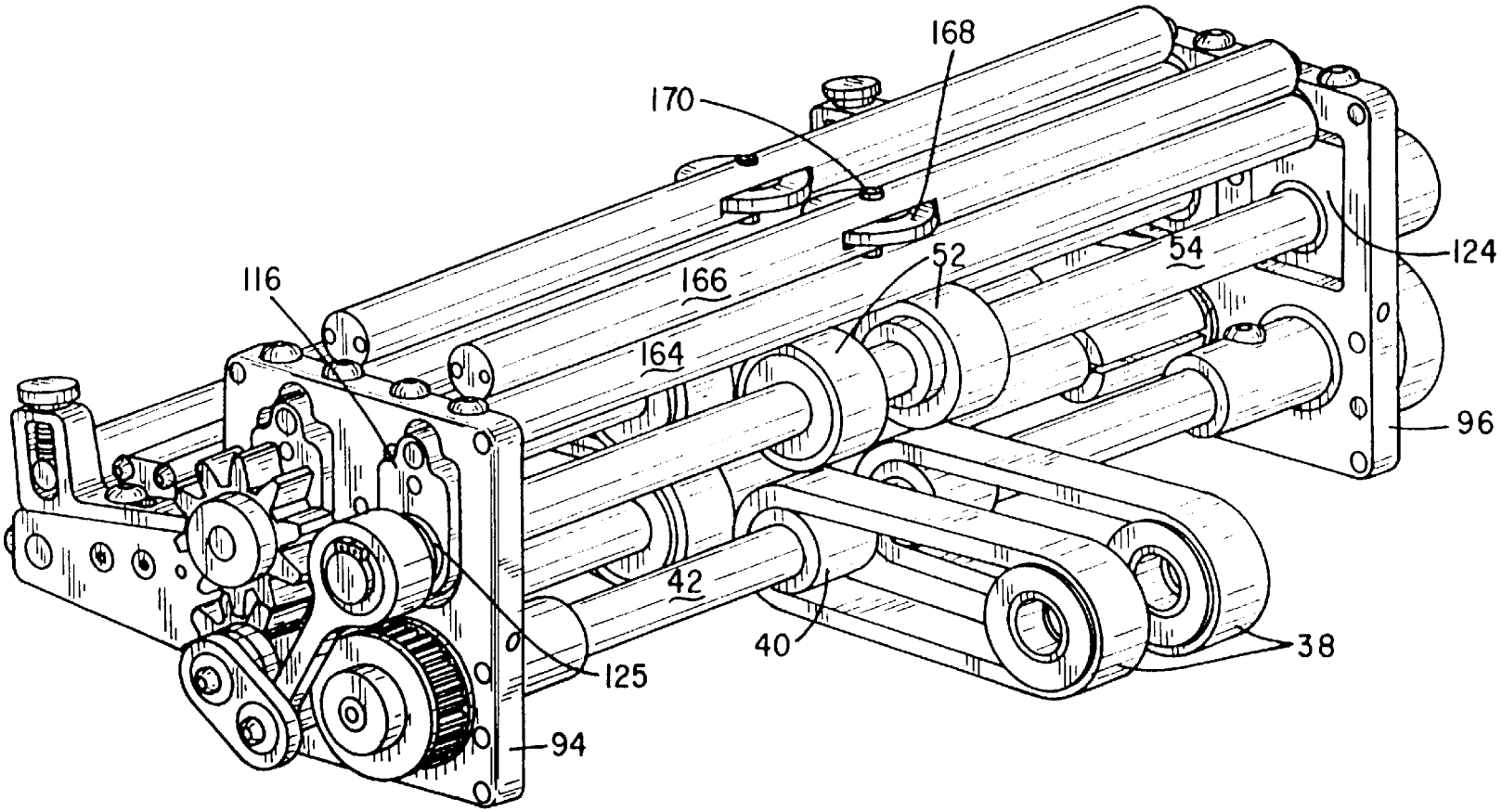
FIG. 8 is a left rear perspective view of the friction feeder with the housings removed.
Figure 11:
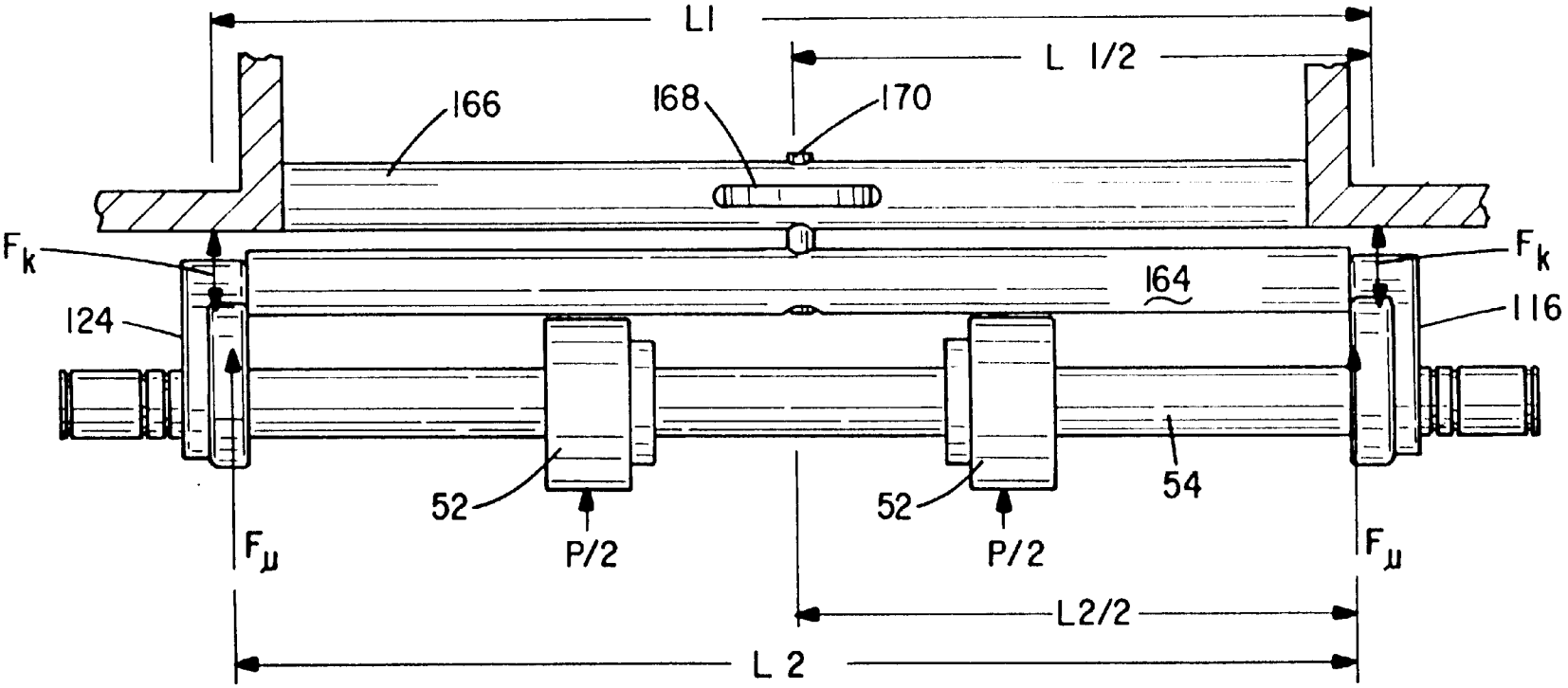
FIG. 11 is a schematic mechanical diagram helpful in understanding the pressure adjustment structure of the preferred embodiment.

Next, referring to FIG. 8, there is shown a lower adjustment shaft 164 that extends between the bearing support plates 94 and 96 and whose ends are fitted into apertures in the floating bearing blocks 116 and 124. Disposed immediately above the lower adjustment rod 164 is an upper stationary adjustment rod 166 whose ends are fixedly attached to the side plates 24 and 26 comprising the frame of the friction feeder 10. Fitted into a slot in the stationary adjustment rod 166 is a thumb wheel 168 to facilitate turning of a threaded rod 170. Rotation of the thumb wheel 168 in a first direction will apply a downward force at the mid-point of the lower adjustment rod 164 which, in turn, will lower the stripper wheel shaft 54 bringing the stripper wheels 52 into closer relation to the upper flights 36 of the endless feed belts 38 entrained over the rollers 40 on the feed belt drive shaft 42. For thicker products, the adjustment thumb wheel 168 will be rotated in the opposite direction thereby lifting the adjustment rod 164 at its midpoint and also lifting the shaft 54 journaled in the slide bearing blocks 116 and 124 against the force of the compression springs previously described. Referring to FIG. 11, there is shown a "free body diagram" of the gap adjustment mechanism for the stripper wheels 52 on the stripper wheel shaft 54. The force exerted on the sliding bearing blocks 116 and 124 by the compression springs are represented by the arrows $F_k$ while the friction forces acting between the sliding bearing blocks and the slots in which they ride in the bearing mounting plates are represented by the arrows labeled $F_\mu$. The top adjustment rod 166 is fixed at both ends to the housing side plates and the entire assembly pivots about the centrally located threaded rod 170. The single screw gap adjustment can be realized if the spring force, $F_k$, is much greater than the friction force, $F\mu$ acting on the sliding bearing blocks. Thus, the spring forces have to be preloaded so as to be significantly greater than the friction forces for the thinnest of articles when the stripper wheels 52 are at their lowest position. This will then provide a constant equal pressure on each stripping wheel, thus ensuring the products will be fed in a straight line and not skewed in passing through the nip.

The single screw adjustment feature is an improvement over prior art arrangements where the stripper wheel shaft is adjusted by pressure screws disposed at opposite ends of the stripper wheel shaft. Achieving equal stripper wheel pressure using two separate adjustment screws has proven to be difficult and much inferior to the single screw height adjustment in the preferred embodiment of the present invention. The linkage arrangements 150, 154 and 142, 146 readily accommodate changes in the height adjustment of the stripper bar shaft 54 relative to the upper flight 36 of the endless feed belt.

Figure 9:
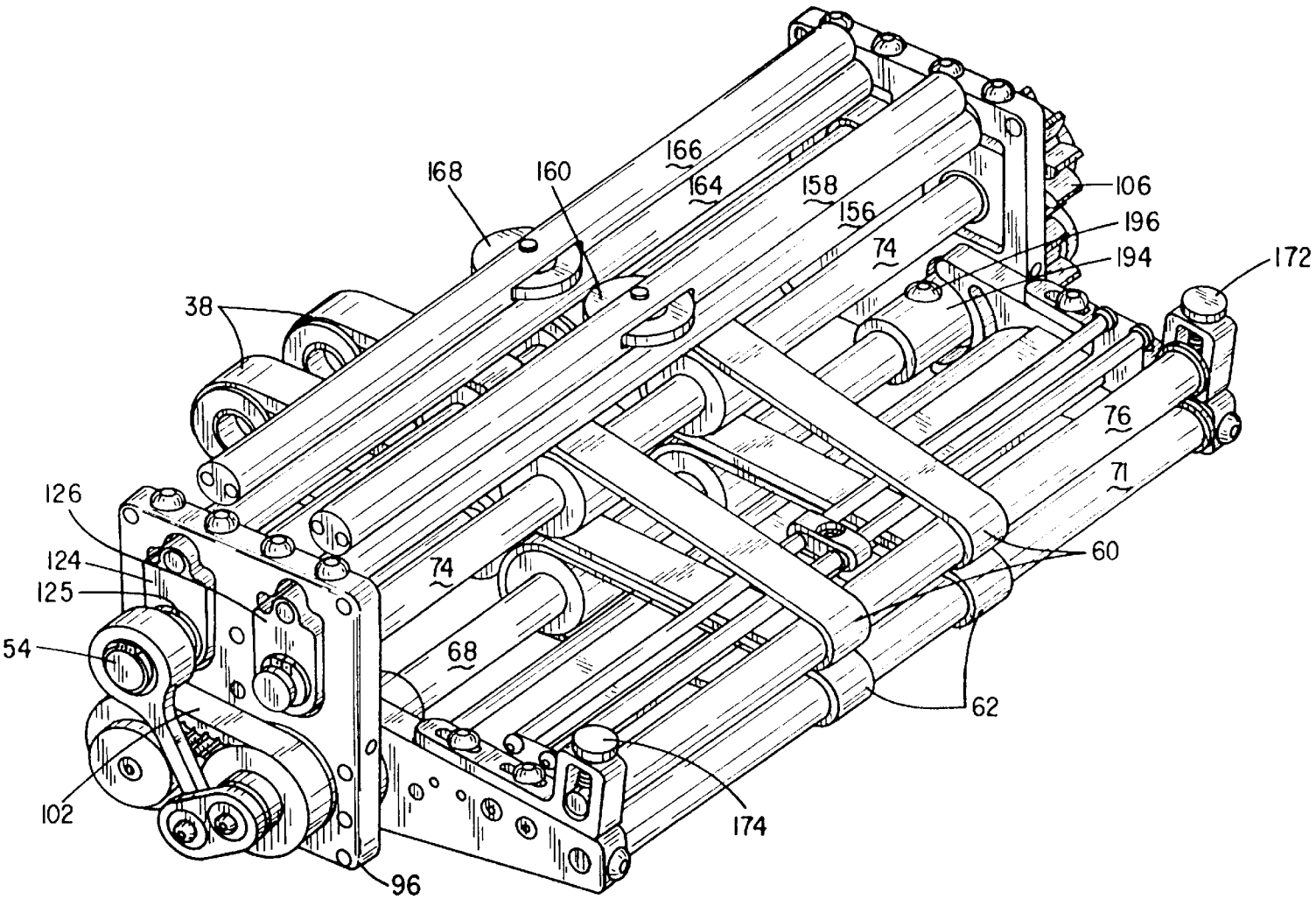
FIG. 9 is a right front perspective view of the friction feeder with the housings removed.
Figure 10:
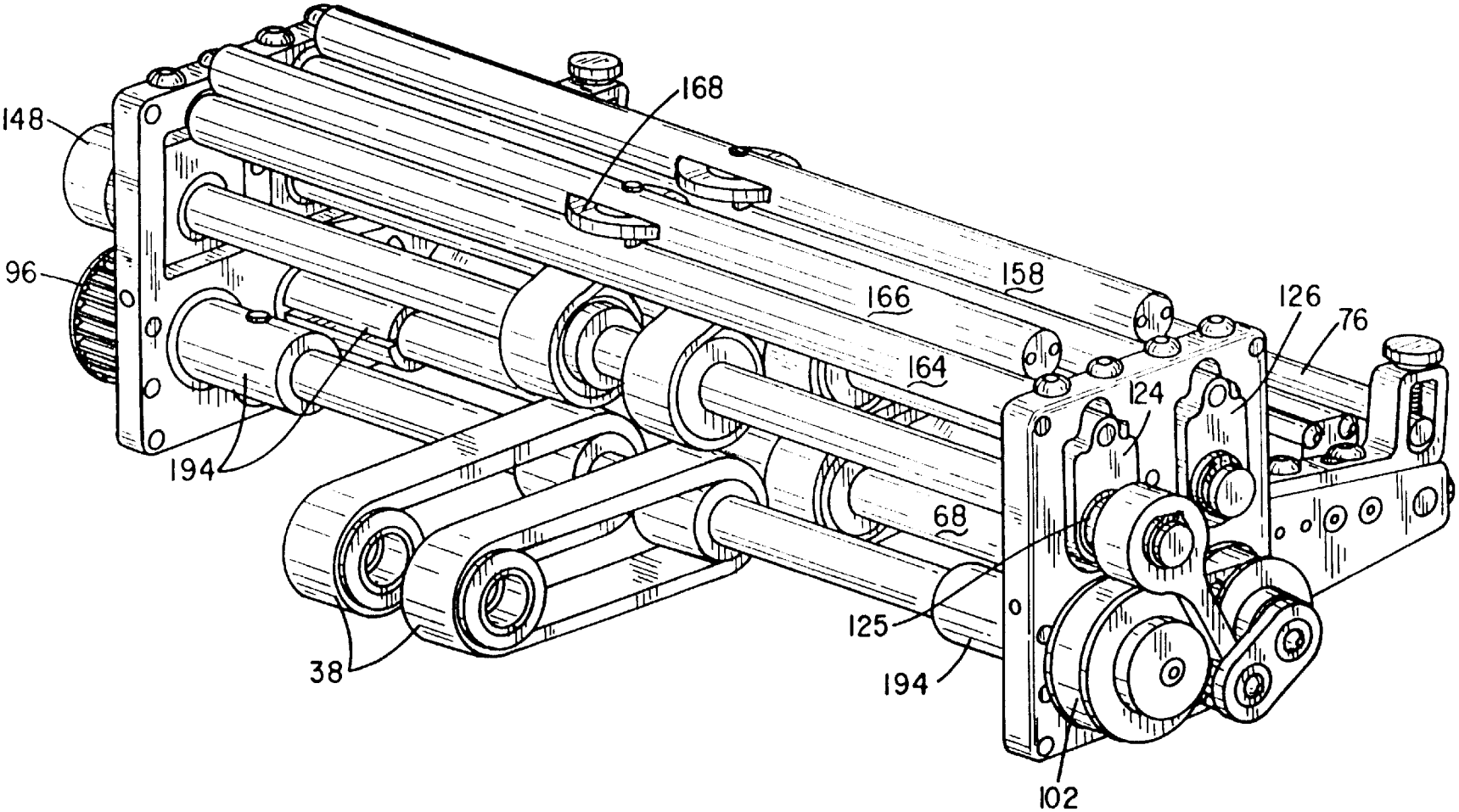
FIG. 10 is a right rear perspective view of the friction feeder with the housings removed.

The spacing between the stationary lower discharge nose idler roller shaft and the stationary upper discharge nose idler roller shaft 76 is controlled by adjustment screws 172 and 174 which cooperate with the opposite ends of the discharge nose roller shafts in a manner that is readily apparent from the drawing of the FIG. 9.

Figure 12:
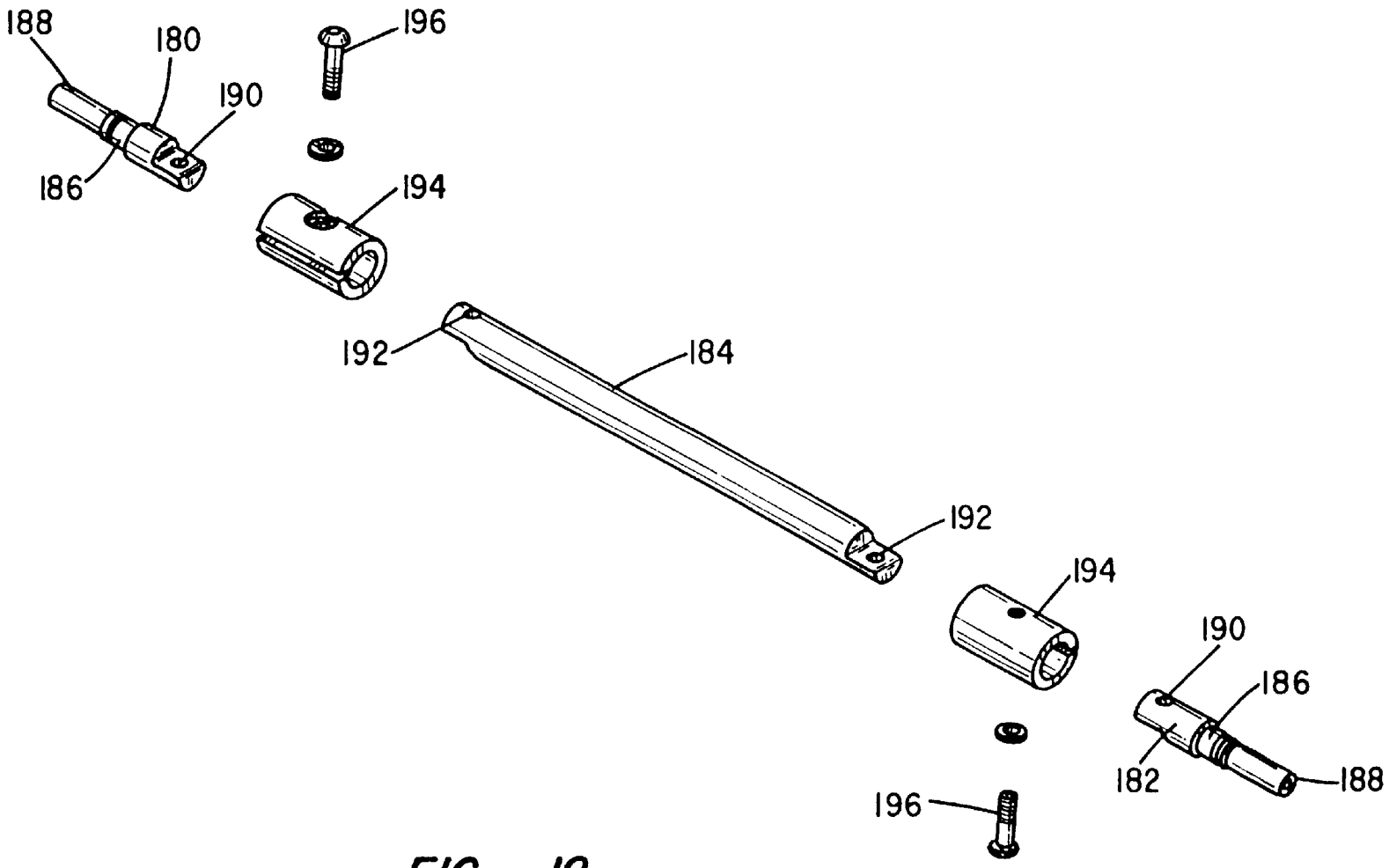
FIG. 12 is an exploded view of a three-piece shaft assembly used in the preferred embodiment.

Another feature of the present invention that adds to its ease of maintenance is the provision of a segmented feed belt drive shaft 42 and a segmented lower discharge shaft 68. Specifically, as shown in FIG. 12, these shafts comprise first and second end portions 180 and 182 and a central portion 184. The end portions are provided with a segment 186 adapted to be fitted within the center race of a set of bearings and a terminal portion 188 on which a drive pulley is affixed. The end portion 180 is provided with a semi-circular notch 190 to receive a semi-circular projection 192 on the shaft segment 184. Thus, when the shaft 184 and its end pieces 180 and 182 are joined together, a right circular cylinder is formed. A bore is provided through the portions 190 and 192 and a split collar 194 can be fitted over the joint between end piece 180 and the shaft 184 and clamped tight by inserting a screw 196 through aligned bores in the collar 194 and in the end pieces 190 and 192. A balanced rigid shaft results.

Should it become necessary to replace the endless belts due to wear and the like, it is not necessary to remove the shaft ends 180 and 182 from their respective bearings, but instead, it only is necessary to remove the screws 196, slide the split collar 194 beyond the joint and then remove the center section 184 of the shaft. Drive belts and discharge belts can thereby be removed and replaced in a matter of about five minutes whereas several hours would be required to do the same job if a one piece solid shaft is utilized.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. An apparatus for feeding sheet articles from the bottom of a stack of such articles comprising:

(a) a frame including (i) first and second box-like housings placed in parallel, spaced-apart relation on opposite sides of the longitudinal path, each of said housings having a housing side plate extending vertically upward there from;

(ii) a plurality of spacer rods affixed to and extending between the housing side plates for maintaining the spaced-apart relation between said first and second housings;

(iii) first and second bearing support plates respectively contained within the first and second box-like housings, said first and second bearing support plates each having a first vertically oriented slot formed therein for containing a first set of sliding bearing blocks; and (iv) biasing means operatively disposed in the first vertically oriented slots of the first and second bearing support plates and cooperating with the first set of sliding bearing blocks for urging the first set of sliding bearing blocks in a downward direction within the first vertically oriented slots;

(b) an endless feed belt and feed belt drive structure supported by said frame for driving an upper flight of the endless feed belt in a forward direction along a fixed, longitudinal path at a first speed;

(c) a hopper disposed above said upper flight for holding a stack of sheet articles such that a lowermost sheet article in the stack is engaged by the upper flight of the endless feed belt;

(d) a first rotatable shaft extending transverse to the longitudinal path and supporting at least one stripper wheel thereon, a periphery of the stripper wheel being adjustably spaced from the upper flight of the endless feed belt to define a gap through which the lowermost sheet article in the stack may pass, opposed ends of the first rotatable shaft journaled in the first set of sliding bearing blocks; and (e) means for continuously rotating the first rotatable shaft when the endless feed belt is being driven and with the periphery of the stripper wheel moving in a direction opposite to the forward direction at the gap and at a speed that is a predetermined small fraction of the first speed at which the endless feed belt is being driven, the at least one stripper wheel cooperating with the sheet articles in the stack above the lowermost sheet article to inhibit their entry into the gap as the lowermost sheet article passes through the gap.

2. The apparatus of claim 1 wherein said hopper includes:

(a) first and second parallel, positionable side plates for constraining lateral movement of the sheet articles in the stack;

(b) a front guide member disposed between said positionable side plates adapted to engage forward edges of the sheet articles in the stack, the front guide member having an arcuate lower end portion curving inwardly toward said gap; and (c) a positionable rear guide member for engaging rearward edges of the sheet articles in the stack, the rear guide member having an arcuate profile corresponding to the arcuate lower end portion of the front guide member.

3. The apparatus as in claim 2 wherein the rear guide member is positionable about three mutually perpendicular axes to accommodate sheet articles of differing size dimensions.

4. The apparatus of claim 1 wherein the belt drive structure comprises:

(a) a motor affixed to the exterior of the first box-like housing and having an output shaft entering the first box-like housing and supporting a drive pulley;

(b) a second rotatable shaft journaled at opposite ends thereof in said first and second bearing support plates and operatively coupled to the drive pulley on the output shaft of the motor; and (c) an idler shaft extending between said first and second box-like housings and supporting rollers thereon with the endless feed belt deployed about the second rotatable shaft and the rollers on the idler shaft.

5. The apparatus of claim 4 and further including:

(a) a discharge assembly supported by the frame downstream of the gap.

6. The apparatus of claim 5 wherein the discharge assembly comprises:

(a) upper and lower endless discharge belts; and (b) a discharge belt drive structure for defining upper and lower cooperating flights for receiving sheet articles therebetween with the upper and lower cooperating flights each moving at the same linear velocity and in the same direction.

7. The apparatus of claim 6 wherein the discharge belt drive structure comprises:

(a) a second, vertically oriented slot formed in each of the first and second bearing support plates for containing a second set of sliding bearing blocks;

(b) further biasing means operatively disposed in the second vertically oriented slots of the first and second bearing support plates and cooperating with the second set of sliding bearing blocks for urging the second set of sliding bearing blocks in a downward direction within the second vertically oriented slot;

(c) means for journaling an upper discharge shaft at opposite ends in said second set of sliding bearing blocks;

(d) means for journaling a lower discharge shaft at opposite ends in the first and second bearing support plates beneath the upper discharge shaft;

(e) upper and lower idler roller shafts having bearing mounted rollers journaled for rotation thereon disposed in the frame in parallel, spaced-apart relation to the upper and lower discharge shafts, said upper discharge belt being deployed about the upper discharge shaft and the bearing mounted rollers on the upper idler roller shaft, said lower discharge belt being deployed about the bearing lower discharge shaft and the bearing mounted rollers on the lower idler roller shaft;

(f) means coupled to the second rotatable shaft for driving the lower discharge shaft; and (g) means coupled to the lower discharge shaft for driving the upper discharge shaft.

8. The apparatus as in claim 7 and further including:

(a) means for adjusting a spacing between cooperating flights of the upper and lower discharge belts.

9. The apparatus as in claim 8 wherein the means for adjusting the spacing between the cooperating flights of the upper and lower discharge belts comprises:

(a) a further adjustment rod member extending between the second set of sliding bearing blocks; and (b) an adjustment screw supported by a second of the plurality of spacer rods affixed to and extending between the housing side plates, said adjustment screw disposed midway between the housing side plates and cooperating with the further adjustment rod member.

10. The apparatus as in claim 7 wherein the means for continuously rotating the first rotatable shaft further comprises:

(a) a pair of one-way ratchet clutch mechanisms affixed to opposite ends of the said first rotatable shaft;

(1)) first and second cranks coupled between said pair of one-way clutch mechanisms and said lower discharge shaft, the first rotatable shaft being rotated through 180° by the first crank and a first of the pair of one-way ratchet clutch mechanisms and through another 180° by the second crank and the second of the pair of one-way ratchet clutch mechanisms.

11. The apparatus as in claim 7 wherein the lower discharge shaft is comprised of separable segments.

12. The apparatus as in claim 7 wherein the upper discharge and the lower discharge shaft are drivingly coupled by spur gears having elongated meshing teeth to permitted limited vertical upward displacement of the upper discharge shaft without disengaging the meshing teeth.

13. The apparatus as in either of claims 7 or 9 wherein the further biasing means comprises compression springs with a spring force that is greater than an frictional forces between the second set of sliding bearing blocks and the walls defining the second vertically oriented slots in the first and second bearing support plates.

14. The apparatus as in claim 4 wherein the second rotatable shaft is comprised of separable segments.

15. The apparatus of claim 4 and further including:

(a) a further endless feed belt deployed about the second rotatable shaft and the idler shaft in parallel relation to the endless feed belt.

16. The apparatus as in claim 15 and further including a further stripper wheel disposed on the first rotatable shaft and in vertical alignment with the further endless feed belt.

17. The apparatus as in claim 4 and further including:

(a) a microprocessor-based electronic motor controller disposed in the second box-like housing and an operator control panel comprising a key pad and an alpha/numeric display disposed atop the second box-like housing.

18. The apparatus as in claim 1 and further including means supported by a first of said plurality of spacer rods and cooperating with the first rotatable shaft for adjusting the spacing between the stripper wheel and the upper flight of the endless feed belt.

19. The apparatus as in claim 18 wherein the means supported by said first spacer rod and cooperating with said first rotatable shaft comprises:

(a) an adjustment rod member coupled to and extending between the first set of sliding bearing blocks in the first and second bearing support plates and an adjustment screw extending between the first spacer rod and the adjustment rod about midway between the housing side plates on the first and second box-like housings.

20. The apparatus as in either of claims 1 or 19 wherein the biasing means comprises:

(a) compression springs having a spring force that is greater than any frictional forces existing between the first set of sliding bearing blocks and the walls defining the vertically oriented slots in the first and second bearing support plates.

21. The apparatus of claim 1 and further including:

(a) a discharge assembly supported by the frame downstream of the gap for receiving and transporting lowermost sheet articles exiting the gap at a speed greater than said first speed.

22. An apparatus for feeding sheet articles from the bottom of a stack of such articles comprising:

(a) a frame;

(b) an endless feed belt and feed belt drive structure supported by said frame for driving an upper flight of the endless feed belt in a forward direction alone a fixed, longitudinal path at a first speed;

(c) a hopper disposed above said upper flight for holding a stack of sheet articles such that a lowermost sheet article in the stack is engaged by the upper flight of the endless feed belt;

(d) a first rotatable shaft extending transverse to the longitudinal path and supporting at least one stripper wheel thereon, a periphery of the stripper wheel being adjustably spaced from the upper flight of the endless feed belt to define a gap through which the lowermost sheet article in the stack may pass; and (e) means including a pair of one-way ratchet clutch mechanisms affixed to opposite ends of the first rotatable shaft, the ratchet clutch mechanism being operatively coupled to the feed belt drive structure for continuously rotating the first rotatable shaft when the endless feed belt is being driven and with the periphery of the stripper wheel moving in a direction opposite to the forward direction at the gap and at a speed that is a predetermined small fraction of the first speed at which the endless feed belt is being driven, the at least one stripper wheel cooperating with the sheet articles in the stack above the lowermost sheet article to inhibit their entry into the gap as the lowermost sheet article passes through the gap.

23. The apparatus as in claim 22 wherein the frame comprises:

(a) first and second box-like housings placed in parallel, spaced-apart relation on opposite sides of the longitudinal path, each of said housings having a housing side plate extending vertically upward there from;

(b) a plurality of spacer rods affixed to and extending between the housing side plates for maintaining the spaced-apart relation between said first and second housings;

(c) first and second bearing support plates respectively contained within the first and second box-like housings, said first and second bearing support plates each having a first vertically oriented slot formed therein for containing a first set of sliding bearing blocks;

(d) biasing means operatively disposed in the first vertically oriented slots of the first and second bearing support plates and cooperating with the first set of sliding bearing blocks for urging the first set of sliding bearing blocks in a downward direction within the first vertically oriented slots; and (e) means for journaling said first rotatable shaft at opposite ends thereof in the first set of sliding bearing blocks.

24. The apparatus of claim 23 wherein said hopper includes:

(a) first and second parallel, positionable side plates for constraining lateral movement of the sheet articles in the stack;

(b) a front guide member disposed between said positionable side plates adapted to engage forward edges of the sheet articles in the stack, the front guide member having an arcuate lower end portion curving inwardly toward said gap; and (c) a positionable rear guide member for engaging rearward edges of the sheet articles in the stack, the rear guide member having an arcuate profile corresponding to the arcuate lower end portion of the front guide member.

25. The apparatus as in claim 24 wherein the rear guide member is positionable about three mutually perpendicular axes to accommodate sheet articles of differing size dimensions.

26. The apparatus of claim 24 wherein the belt drive structure comprises:

(a) a motor affixed to the first box-like housing and having an output shaft disposed within the first box-like housing for rotating a drive pulled;

(b) a second rotatable shaft journaled at opposite ends thereof in said first and second bearing support plates and operatively coupled to the drive pulley on the output shaft of the motor; and (c) an idler shaft extending between said first and second box-like housings and supporting rollers thereon with the endless feed belt deployed about the second rotatable shaft and the rollers on the idler shaft.

27. The apparatus of claim 26 and further including:

(a) a discharge assemble supported by the frame downstream of the gap.

28. The apparatus of claim 27 wherein the discharge assembly comprises:

(a) upper and lower endless discharge belts; and (b) a discharge belt drive structure for defining upper and lower cooperating flights for receiving sheet articles therebetween with the upper and lower cooperating flights each moving at the same linear velocity and in the same direction.

29. The apparatus of claim 28 wherein the discharge belt drive structure comprises:

(a) a second, vertically oriented slot formed in each of the first and second bearing support plates for containing a second set of sliding bearing blocks;

(b) further biasing means operatively disposed in the second vertically oriented slots of the first and second bearing support plates and cooperating with the second set of sliding bearing blocks for urging the second set of sliding bearing blocks in a downward direction within the second vertically oriented slot;

(c) means for journaling an upper discharge shaft at opposite ends in said second set of sliding bearing blocks;

(d) means for journaling a lower discharge shaft at opposite ends in the first and second bearing support plates beneath the upper discharge shaft;

(e) upper and lower idler roller shafts having bearing mounted rollers journaled for rotation thereon disposed in the frame in parallel, spaced-apart relation to the upper and lower discharge shafts, said upper discharge belt being deployed about the upper discharge shaft and the bearing mounted rollers on the upper idler roller shaft, said lower discharge belt being deployed about the bearing lower discharge shaft and the bearing mounted rollers on the lower idler roller shaft;

(f) means coupled to the second rotatable shaft for driving the lower discharge shaft; and (g) means coupled to the lower discharge shaft for driving the upper discharge shaft.

30. The apparatus as in claim 29 and further including:

(a) means for adjusting a spacing between cooperating flights of the upper and lower discharge belts.

31. The apparatus as in claim 30 wherein the means for adjusting the spacing between the cooperating flights of the upper and lower discharge belts comprises:

(a) a further adjustment rod member extending between the second set of sliding bearing blocks; and (b) an adjustment screw supported by the second spacer rod affixed to and extending between the housing side plates, said adjustment screw disposed midway between the housing side plates and cooperating with the further adjustment rod member.

32. The apparatus as in claim 29 wherein the means for continuously rotating the first rotatable shaft comprises:

(a) first and second cranks coupled between said pair of one-way clutch mechanisms and said lower discharge shaft, the first rotatable shaft being rotated through 180° by the first crank and a first of the pair of one-way ratchet clutch mechanisms and through another 180° by the second crank and the second of the pair of one-way ratchet clutch mechanisms.

33. The apparatus as in claim 29 wherein the lower discharge shaft is comprised of separable segments.

34. The apparatus as in claim 29 wherein the upper discharge and the lower discharge shaft are drivingly coupled by spur gears having elongated meshing teeth to permitted limited vertical upward displacement of the upper discharge shaft without disengaging the meshing teeth.

35. The apparatus as in either of claims 29 or 31 wherein the further biasing means comprises compression sprints with a spring force that is greater than an frictional forces between the second set of sliding bearing blocks and the walls defining the second vertically oriented slots in the first and second bearing support plates.

36. The apparatus as in claim 26 wherein the second rotatable shaft is comprised of separable segments.

37. The apparatus of claim 26 and further including:

(a) a further endless feed belt deployed about the second rotatable shaft and the idler shaft in parallel relation to the endless feed belt.

38. The apparatus as in claim 37 and further including a further stripper wheel disposed on the first rotatable shaft and in vertical alignment with the further endless feed belt.

39. The apparatus as in claim 26 and further including:

(a) a microcomputer-based electronic motor controller disposed in the second box-like housing and an operator control panel comprising a key pad and an alpha/numeric display disposed atop the second box-like housing.

40. The apparatus as in claim 23 and further including means supported by a first of said plurality of spacer rods and cooperating with the first rotatable shaft for adjusting the spacing between the stripper wheel and the upper flight of the endless feed belt.

41. The apparatus as in claim 40 wherein the means supported by said first spacer rod and cooperating with said first rotatable shaft comprises:

(a) an adjustment rod member coupled to and extending between the first set of sliding bearing blocks in the first and second bearing support plates and an adjustment screw extending between the first spacer rod and the adjustment rod about midway between the housing side plates on the first and second box-like housings.

42. The apparatus as in either of claims 24 or 41 wherein the biasing means comprises:

(a) compression springs having a spring force that is greater than any frictional forces existing between the first set of sliding bearing blocks and the walls defining the vertically oriented slots in the first and second bearing support plates.

43. The apparatus of claim 22 and further including:

(a) a discharge assembly supported by the frame downstream of the gap for receiving and transporting lowermost sheet articles exiting the gap at a speed greater than said first speed.

* * * * *

UNITED STATES PATENT AND TRADEMARK OFFICE

CERTIFICATE OF CORRECTION

PATENT NO. : 6,050,563
DATED : April 18, 2000
INVENTOR(S) : Arild Vedoy, et al.

It is certified that error appears in the above-identified patent and that said Letters Patent is hereby corrected as shown below:

Claim 10, line 6, change"(1))" to -- (b) --.

Claim 26, line 5, change "pulled" to -- pulley --.

Claim 27, line 2, change "assemble" to -- assembly --.

Claim 35, line 2, change "sprints" to -- springs --.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*